US005708451A

United States Patent [19]

Baldi

[11] Patent Number: 5,708,451

[45] Date of Patent: Jan. 13, 1998

[54] METHOD AND DEVICE FOR UNIFORMING LUMINOSITY AND REDUCING PHOSPHOR DEGRADATION OF A FIELD EMISSION FLAT DISPLAY

[75] Inventor: Livio Baldi, Agrate Brianza, Italy

[73] Assignee: SGS-Thomson Microelectronics, S.r.l., Agrate Brianza, Italy

[21] Appl. No.: 681,099

[22] Filed: Jul. 22, 1996

[30] Foreign Application Priority Data

Jul. 20, 1995 [EP] European Pat. Off. ..... 95830314

[51] Int. Cl.[6] ..... G09G 3/36

[52] U.S. Cl. ..... 345/75; 313/391; 313/398; 313/422; 345/63; 345/77; 345/204; 348/687

[58] Field of Search ..... 313/391, 398, 313/422; 345/63, 75, 77, 147, 204, 214; 348/687, 714

[56] References Cited

U.S. PATENT DOCUMENTS

| | | | |
|---|---|---|---|
| 4,525,653 | 6/1985 | Smith | 315/366 |
| 4,694,225 | 9/1987 | Tomii et al. | 315/366 |
| 5,262,698 | 11/1993 | Dunham | 315/169.1 |
| 5,440,322 | 8/1995 | Prince et al. | 345/58 |
| 5,625,373 | 4/1997 | Johnson | 345/58 |

FOREIGN PATENT DOCUMENTS

| | | |
|---|---|---|
| 0184901 | 5/1997 | European Pat. Off. . |
| 2683365 | 5/1997 | France . |

*Primary Examiner*—Mark R. Powell
*Assistant Examiner*—Vincent E. Kovalick
*Attorney, Agent, or Firm*—Robert Groover; Betty Formby; Matthew Anderson

[57] ABSTRACT

Nonuniformities of luminance characteristics in a field emission display (FED) are compensated pixel by pixel by storing a matrix of correction values, determined by testing, and by applying a corrected drive signal through the relative column drive stages. The individual pixel's correction factor that is applied to the corresponding video signal may be stored in digital or analog form in a nonvolatile memory array. Various embodiments are described including the use of a second updatable RAM array wherein pixel's correction factors are calculated and stored at every power-on to provide an opportunity of trimming-up the luminance of the display for compensating long term decline of luminance due to the phosphors ageing process.

46 Claims, 3 Drawing Sheets

VIDEO SIGNAL

SYNCHRONIZATION SIGNAL
ADDRESS GENERATOR
CORRECTION MATRIX
CORRECTION CIRCUIT
DRIVER
DRIVER
DRIVER
DRIVER
COLUMNS
ROWS

VIDEO SIGNAL

SYNCHRONIZATION SIGNAL
CORRECTION MATRIX
CORRECTION CIRCUITS
DRIVER
DRIVER
DRIVER
DRIVER
COLUMNS
ROWS

METHOD AND DEVICE FOR UNIFORMING LUMINOSITY AND REDUCING PHOSPHOR DEGRADATION OF A FIELD EMISSION FLAT DISPLAY

CROSS-REFERENCE TO RELATED APPLICATION

This application claims priority from EP 95830314.1, filed Jul. 20, 1995, which is hereby incorporated by reference.

BACKGROUND AND SUMMARY OF THE INVENTION

This invention relates to a method and a circuital device for regulating the cathode current of flat panel displays (FPD) of the field emission type (FED) by compensating for nonuniformities resulting from the process of fabrication as well as reducing the display ageing and degrading process.

The continuous evolution towards portable electronic products such as laptop computers, personal organizers, pocket TVs and electronics games, has created an enormous market for monochromatic or color display screens of small dimensions and reduced thickness, having a light-weight and a low dissipation. Especially the first two requirements cannot be met by conventional cathode ray tubes (CRTs). For this reason, among the emerging technologies, let alone those related to liquid-crystal-displays (LCD), flat panel field emission display technology has been receiving increasing attention by the industry.

A remarkable research and development work has been carried out in the past few decades on field emission displays (FED) employing a cathode in the form of a flat panel provided with a dense population of emitting microtips co-operating with a grid-like extractor essentially coplanar to the apexes of the microtips. The cathode-grid extractor structure is a source of electrons that are accelerable in a space, evacuated for ensuring an adequate mean free-path, towards a collector (anode) constituted by a thin and transparent conductor film upon which are placed luminescent phosphors excited by the impinging electrons. Emission of electrons is controllably excitable pixel by pixel through a matrix of columns and rows, constituted by parallel strips of said population of microtips and parallel strips of said grid-like extractor, respectively. The fundamental structure of these display systems and the main problems related to the fabrication technology, reliability and durability, as well as those concerning the peculiar way of exciting individual pixels of the display system and various proposed solutions to these problems, are discussed and described in a wealth of publications on these topics. Among the pertinent literature the following publications may be cited:

U.S. Pat. No. 5,391,259; Cathey, et al.
U.S. Pat. No. 5,387,844; Browning
U.S. Pat. No. 5,357,172; Lee, et al.
U.S. Pat. No. 5,210,472; Casper, et al.
U.S. Pat. No. 5,194,780; Meyer
U.S. Pat. No. 5,064,396; Spindt
U.S. Pat. No. 4,940,916; Borel, et al.
U.S. Pat. No. 4,857,161; Borel, et al.
U.S. Pat. No. 3,875,442; Wasa, et al.
U.S. Pat. No. 3,812,559; Spindt, et al.
U.S. Pat. No. 3,755,704; Spindt, et al.
U.S. Pat. No. 3,655,241; Spindt, et al.

"Beyond AMLCDs: Field emission displays?", K. Derbyshire, Solid State Technology, November 94;

"The state of the Display", F. Dawson, Digital Media, Febuary--March 94;

"Competitive Display Technologies", 1993, Stanford Resources, Inc.;

"Field-Emission Display Resolution", W. D. Kesling, et al., University of California, SID 93 DIGEST 599--602;

"Phosphors For Full-Color Microtips Fluorescent Displays", F. Lévy, R. Meyer, LETI-DOFT-SCMM, IEEE 1991, pages 20--23;

"Diamond-based field emission flat panel displays", N. Kumar, H. Schmidt, Solid State Technology, May 1995, pages 71--74;

"Electron Field Emission from Amorphic Diamond Thin Films", Chenggang Xle, et al., Microelectronics and Computer Technology Corporation, Austin, Tex.; University of Texas and Dallas, Richardson, Tex.; SI Diamond Technology, Inc., Houston, Tex.;

"Field Emission Displays Based on Diamond Thin Films", Natin Kumar, et al:, Microelectronics and Computer Technology Corporation, Austin, Tex.; Elliot Schlam Associates, Wayside, N.J.; SI Diamond Technology, Inc., Houston, Tex..;

"U.S. Display Industry on the Edge", Ken Werner, Contributing Editor, IEEE Spectrum, May 1995;

"FEDs: The sound of silence in Japan", OEM Magazine, April 1995, pages 49, 51;

"New Structure Si Field Emitter Arrays with low Operation Voltage", K. Koga, et al., 2.1.1, IEDM 94--23., all of which are hereby incorporated by reference The major advantages of FEDs compared to modern LCDs are:

low dissipation;

same color quality of traditional CRTs;

visibility from any viewing angle.

FED technology has developed itself on the basic teachings contained in U.S. Pat. No. 3,665,241; 3,755,704 and 3,812,559 of C. A. Spindt and in U.S. Pat. No. 3,875,442 of K. Wasa, et al., all of which are hereby incorporated by reference.

FED technology connects back to conventional CRT technology, in the sense that light emission occurs in consequence of the excitation of the phosphors deposited on a metallized glass screen bombarded by electrons accelerated in an evacuated space. The main difference consists in the manner in which electrons are emitted and the image is scanned.

A concise but thorough account of the state of modern FED technology is included in a publication entitled "Competitive Display Technologies---Flat Information Displays" by Stanford Resources. Inc., Chapter B "Cold Cathode Field Emission Displays", which is hereby incorporated by reference. A schematic illustration contained in said publication and giving a comparison between a conventional CRT display and a FED (or FED array) is herein reproduced in FIG. 1. In a traditional CRT there is a single cathode in the form of an electron gun (or a single cathode for each color) and magnetic or electrostatic yokes deflect the electron beam for repeatedly scanning the screen, whereas in a FED the emitting cathode is constituted by a dense population of emission sites distributed more or less uniformly over the display area. Each site is constituted by a microtip electrically excitable by means of a grid-like extractor. This flat cathode-grid assembly is set parallel to the screen, at a relatively short distance from it. The scanning by pixel of the display is performed by sequentially exciting individually addressable groups of microtips by biasing them with an adequate combination of grids and cathode voltages.

As shown in FIG. 2, a certain area of the cathode-grid structure containing a plurality of microtips and corresponding to a pixel of the display is sequentially addressed through a driving matrix organized in rows and columns (in the form of sequentially biasable strips, into which the cathode is electrically divided and of sequentially biasable strips into which the grid extractor is electrically divided, respectively).

A typical scheme of the driving by pixel of the cathodic structure of a FED is shown in FIG. 3. This figure illustrates the driving scheme of a fragment of nine adjacent pixels through a combination of the sequential row biasing pulses for the three rows R1, R2, R3, relative to a certain bias configuration of the three columns C1, C2 and C3.

A typical cross-sectional view of a FED structure is shown in FIG. 4.

The microtip cathode plate generally comprises a substrate of an isolating material such as glass, ceramic, silicon (GLASS BACKPLATE 402), onto which is deposited a low resistivity conductor layer 406 as for example a film of aluminum, niobium, nickel or of a metal alloy (NICKEL ELECTRODE), eventually interposing an adhesion layer 404 for example of silicon (SILICON FILM) between the substrate 402 and the conductor layer 406. The conductor layer 406 (NICKEL ELECTRODE) is photolithographically patterned into an array of parallel strips each constituting a column of a driving matrix of the display. A dielectric layer 408, for example of an oxide (SILICON DIOXIDE), is deposited over the patterned conductor layer. A conductor layer 410 (NIOBIUM GATE METAL), from which the grid extractor will be patterned, is deposited over the dielectric layer. The grid structure is eventually defined in parallel strips, normal to the cathode parallel strips (NICKEL ELECTRODE). According to a known technique, microapertures or wells that reach down to the surface of the underlying patterned conductor layer (NICKEL ELECTRODE) are defined and cut through the grid conductor layer (NIOBIUM GATE METAL) and through the underlying dielectric layer (SILICON DIOXIDE). Onto the surface of the conductor layer exposed at the bottom of the "wells", are fabricated microtips 412 (MOLYBDENUM MICROTIPS) that will constitute as many sites of emission of electrons. On the inner face of a glass faceplate 420 of the display is deposited a transparent thin conducting film 418, for example of a mixed oxide of indium and tin (ITO CONDUCTOR) upon which is deposited a layer of phosphors 416 (monochromatic phosphor or color phosphors) excitable by the electrons accelerated toward the conducting layer (ITO CONDUCTOR) acting as a collector of the electrons emitted by the microtips. (The emission is stimulated by the electric field produced by suitably biasing the grid conductor and the cathode tips.)

In order to improve color resolution, the realization of a "switched" anodic (collector) structure for separately biasing adjacent strips, each covered with a phosphor of a different basic color, has been suggested in a publication entitled: "Phosphors For Full-Color Microtips Fluorescent Displays" by F. Lévy and R. Mayer, LETI - DOFT - SCMM, Grenoble-Cedex-France, which is hereby incorporated by reference.

Fabricating processes of microtips cathode plates are described in U.S. Pat. Nos. 4,857,161; 4,940,916; 5,194,780 and 5,391,259, all of which are hereby incorporated by reference.

As an alternative to microtip cathode structures, the utilization of a film of amorphous diamond formed on a patterned conductor layer supported by a plate of dielectric material, by flash evaporation of carbon atoms from a target of graphite or other carbon material, has recently been suggested. The amorphous diamond film seems to offer extraordinary field emission characteristics (low extraction energy of electrons). Emission current densities of up to 100 $mA/mm^2$ have been recorded with a bias of less than 20V/μm that can be complied with by simply imposing a manageable voltage difference between the emitting cathodic surface constituted by the amorphous diamond film and a phosphor coated screen (anode), without requiring the formation of emitting microtips and of an extraction grid. In this case, the pixels are addressable through a driving matrix of orthogonal lines simply constituted by cathodic (columns) and anodic (rows) strips. The intrinsic emission properties of an amorphous diamond film give way to a substantial structural simplification of the panel. Nevertheless, this alternative technique of constituting a FED device still presents remarkable problems in terms of ensuring an acceptable uniformity of the characteristics of the cathodic structure.

In general terms there exists a well recognized problem of ensuring an uniform luminance (brightness) of the display that involves a control of the emission current of each single microtip (commonly in the order of several hundreds) that belong to a singularly addressable pixel (area) of the display.

While on one hand an occasional reduction of the emission efficiency of single tips is not in itself a cause of failure in view of the fact that each pixel is constituted by a multiplicity of microtips working in parallel, on the other hand, the presence of microtips having an emission efficiency much higher than average is particularly detrimental, because of the following effects:

a) screen faults in the form of intensely bright spots;

b) (in extreme cases) severe damage to the panel by evaporation of the tip and of the adjoining grid.

Essentially the current emitted by each single tip depends on two factors:

i) the radius of curvature of the microtip, which depends on the fabrication technique;

ii) the electric field near the vertex of the microtip which depends on the distance between the tip and the adjoining grid.

Both these geometric parameters depend on the process of fabrication and therefore present a certain statistic dispersion (spread).

Even in the case of cathode structures based on the use of a highly emissive film of amorphous diamond deposited over parallel conducting strips defined on the surface of a dielectric substrate, the field emission characteristics of a given portion of surface, defined by the addresses of the driving matrix (that is of the area sustaining the electric field of excitation of the corresponding pixel), are subject to a rather marked spread because of the difficulties of controlling the uniformity of deposition of the amorphous diamond film.

Another problem is tied to the ageing of the display, that is, the reduction of the luminance resulting from a progressive reduction of the phosphors' efficiency. This ageing process is closely connected to the electronic bombardment and therefore tends to become faster in correspondence of bright spots and is generally faster the higher is the initial pixel current.

Nonuniformity

The problem of nonuniformity is well recognized and various solutions have been proposed. In particular a solution that is widely used is that of interposing between the conductive layer of the strips into which the cathode is subdivided (which constitute the columns of the pixel driving matrix) and the microtips a resistive layer, generally constituted by amorphous and/or polycrystalline silicon, suitably doped, as described in U.S. Pat. No. 4,940,916 and in the publication entitled "Current limiting of field emitter array cathodes" by K. J. Lee, University of Georgia, which is hereby incorporated by reference.

Even this solution has its drawbacks because it is extremely difficult to control the resistivity of a necessarily thin layer of polycrystalline and/or amorphous silicon in a satisfactory manner for limiting the current emitted by the microtips of an addressed pixel of the display.

Under certain aspects, a more efficient solution consists in using electrodes (e.g. cathode conductors) patterned in a grating-like, form where the conductive and the associated resistive portions are substantially coplanar as described in the U.S. Pat. No. 5,194,780. The increased uniformity is obtained at the expenses of a remarkable increase of the complexity of the fabrication process and of costs, which is hereby incorporated by reference.

Altogether these known solutions have only slight impact on the related problem of the aging of the phosphors.

In addition, as stated above, the scanning of a FED screen takes place by selecting one row (that is one strip of the grid extractor) at the time, in succession, while the luminance (brightness) of the single pixels is controlled by modulatedly biasing the columns (connected to the cathode electrodes) which are scanned in sequence.

According to a first technique, the pixel current is controlled by the voltage difference existing between cathode tips of the selected pixel and the respective grid extractor strip (selected row). According to an alternative technique, the luminance (brightness) is controlled by regulating the excitation time of the pixel, that is in scanning the columns with signals having the same amplitude but different duration.

SUMMARY OF THE INVENTION

The method and the device of the invention for compensating for the nonuniformities of intrinsic luminance characteristics of a FED consist in processing the signal that is used for driving the display pixels and will be described in depth by referring to the case of video signals. However, the concept can be easily expanded to alphanumerical applications or to computer monitors.

According to a first aspect of the present invention an effective compensation of nonuniformities is attained by using a correction matrix of the pixel driving signals, constituted by a memory cell array of adequate dimensions, wherein data stored in the memory in the form of words (bytes) of a certain number of bits have a biunivocal correspondence with the pixels of the screen. Each of these data or words contains a calibration value that is used for correcting the level of the signal (for instance a video signal) that drives the corresponding pixel. This calibration value is tied to a previously measured emission efficiency of the corresponding pixel. In this way, intrinsic nonuniformities of emission characteristics of the various pixels are compensated (corrected), thus ensuring a uniform luminance (brightness) of the FED.

The stored datum for each pixel can be a word of relatively short length (small number of bits): for example a length of four bits will permit to obtain sixteen different correction values. This number of different correction values is quite sufficient for compensating even relatively large differences of intrinsic brightness that are likely to occur among the pixels of the cathodic structure (that is the cathode and extractor grid assembly). Moreover, compensation may be implemented according to a linear law, or in different modes, as for example according to a logarithmic law, should the differences (spread) to be compensated for, which may be typical of a certain fabrication process, be particularly large.

The invention is primarily useful for compensating nonuniformities due to the fabrication process of a FED structure. The invention is equally useful for a FED device based on the of a microtip cathode structure comprising an extractor grid as well as for a FED device based on the use of an emitting cathodic structure constituted by biasable strips of a high emissivity amorphous diamond film.

In the course of the present description, eventual references or illustration of a microtip cathode structure should be considered as purely indicative and in no way limitative, because the invention is equally useful even in the case of cathodic structures of different type but having similar problems of nonuniformity among individual pixel's emission characteristics throughout the whole surface of the display.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1:
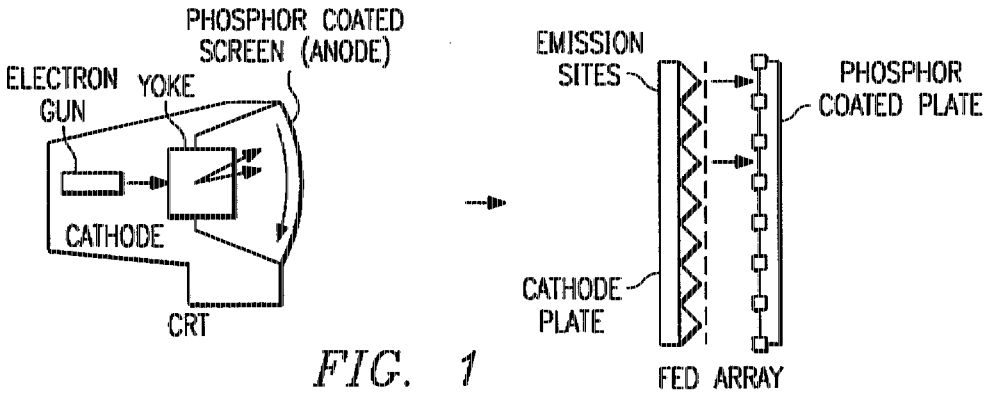
FIG. 1 is a general comparative scheme between a conventional CRT display device and a field emission flat array display device (FED)
Figure 2:
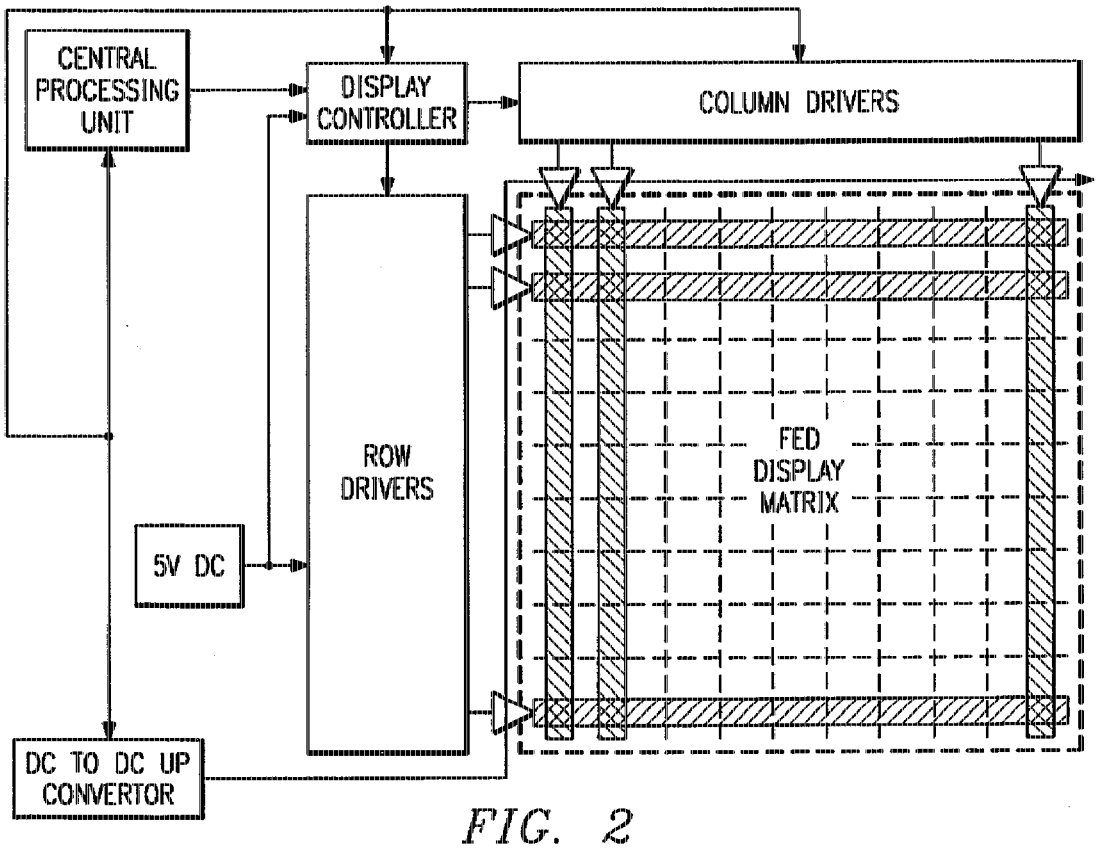
FIG. 2 shows the general architecture of a FED device and of the relative driving circuitry.
Figure 3:
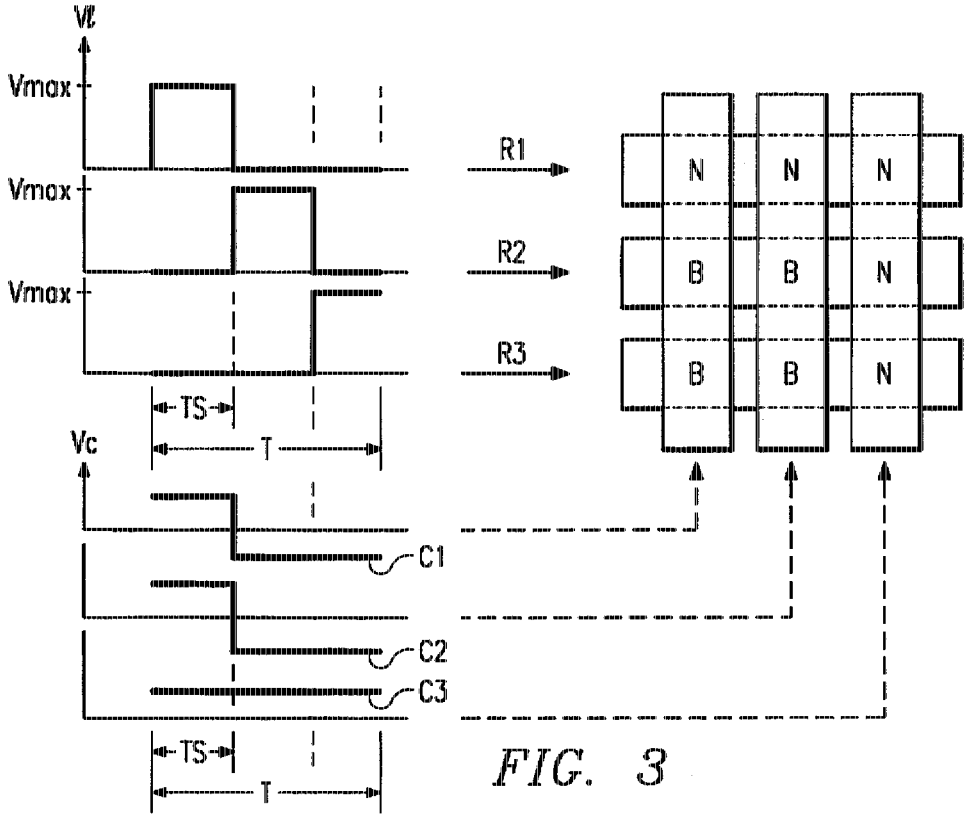
FIG. 3 is an illustration of how every single pixel of a FED device is driven.
Figure 4:
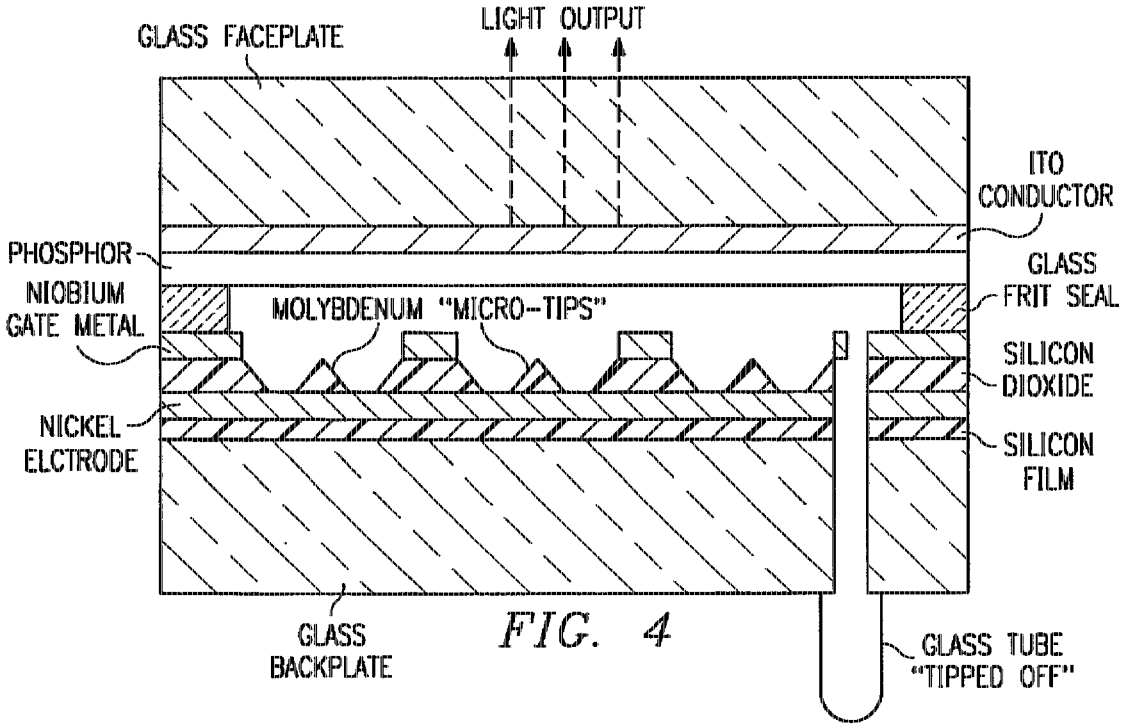
FIG. 4 is a schematic cross sectional illustration of the structure of a FED device.

The numerous innovative teachings of the present application will be described with particular reference to the presently preferred embodiment (by way of example, and not of limitation), in which:According to a first embodiment of the invention, schematically shown in FIG. 5, the memory for storing the correction matrix is a nonvolatile, read only, memory of the EPROM, OTP or FLASH-EPROM type. As a matter of example, for a monochromatic display having 360 columns and 288 rows, it may be required to store a total of about 104,000 words. Assuming a word length of 4 bits, a memory of 0.5 Mbit will be appropriate. This size is quite compatible with nonvolatile memories available nowadays in either EPROM, FLASH-EPROM or EEPROM technology. Of course, for a color display the correction memory size requirement may grow by a factor of 3, yet remaining within a commonly available commercial range.

The data acquisition for the correction matrix, can take place during a final quality control testing of the fabricated display.

According to a first embodiment, this can be undertaken by monitoring the emission current under fixed bias values of cathode and grid voltages for each singularly addressed pixel, and by storing in the correction matrix a number proportional to the ratio between the measured emission current and a certain given reference value. This number can be used directly, or after processing it through an appropriate algorithm, as an "attenuation" factor to be applied through the relative drive circuits to the signal that actually drives the corresponding pixel, whether such a drive signal is modulated in terms of amplitude (voltage) or duration (time). In this manner, an almost perfect compensation of the emission nonuniformities of the cathode, resulting from the process spread, can be achieved.

According to a different embodiment, the pixel correction factors stored in a nonvolatile memory array are proportional to the intensity of the light signal picked up by a photocell suitably placed in front of the FED undergoing testing, while the pixels are sequentially excited (scanned one by one) by a biasing signal of a fixed preset level. In this way, the correction factor that will be applied to each individual pixel is directly proportional to the measured pixel luminance. Therefore it is possible to correct the compounded effects of the disuniformities of the cathode structure and of the possible disuniformities of the light emitting phosphor layer of the display, that is of the anode structure which also comprises the layer or layers of phosphors.

A further embodiment of the invention may be exploited for reducing also the problem connected with screen degradation in time.

According to this alternative embodiment, a matrix of correction values is stored in an electrically alterable memory array, for example an EEPROM or DRAM or SRAM memory array and a matrix of correction data is generated and stored in the memory each time the display is switched-on. According to this embodiment, during a self-testing phase that is automatically run at power-on, a control logic circuitry performs a sequential stimulation of all the rows with a constant amplitude signal, monitors the current flowing in the column drivers, and stores in the memory a digital value proportional to the ratio between the read current and a reference current level.

By suitably fixing a reference value (current level) to be just lower than the maximum obtainable, and preferably as close as possible to an acceptable intermediate value, a new screen will be advantageously excited at the start of its operating life by a signal of an intermediate level. Of course, the correction attenuation values may be gradually increased to compensate for the ageing of the cathode due for instance to a degradation of the microtips as a result the presence of residual gases, that tend to reduce their emission efficiency, just by trimming up the reference value.

In this way, besides correcting nonuniformities and retarding the ageing process by lowering the level of the "initial" current, a compensation, up to a certain limit of the ageing is made possible, thus extending the operational life of the screen overall. Obviously, this embodiment does not lend itself to provide a compensation of nonuniformities of the phosphors.

Beside the type of memory, it is also possible to choose among different configurations of the memory array.

For example, a standard video signal conceived for a conventional CRT, is essentially sequential and includes row and screen-refresh synchronization signals. The driving of a flat panel display (FPD) whether of the field emission type (FED) or of the liquid crystal type (LCD), requires a partial parallelization of a standard video signal by loading the frame relative to the scanning of a row on a buffer, which is then unloaded in parallel over the respective column drivers.

Figure 5:
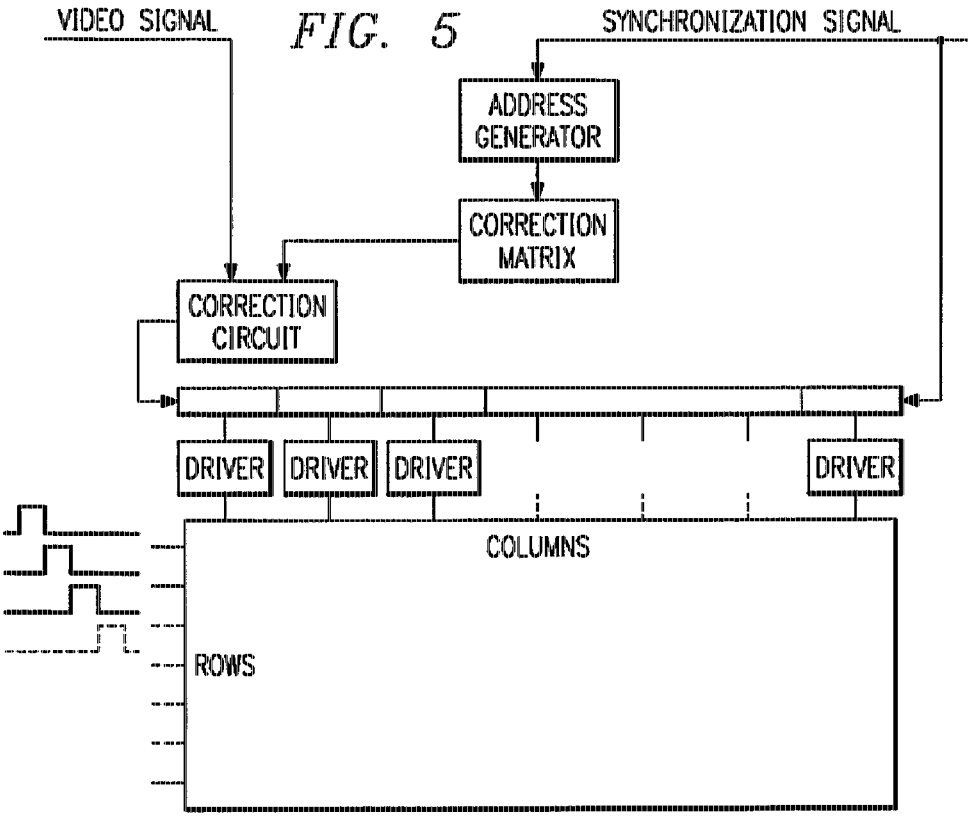
FIG. 5 shows the architecture of a FED device of the invention, provided with individual pixel brightness compensation system.
Figure 6:
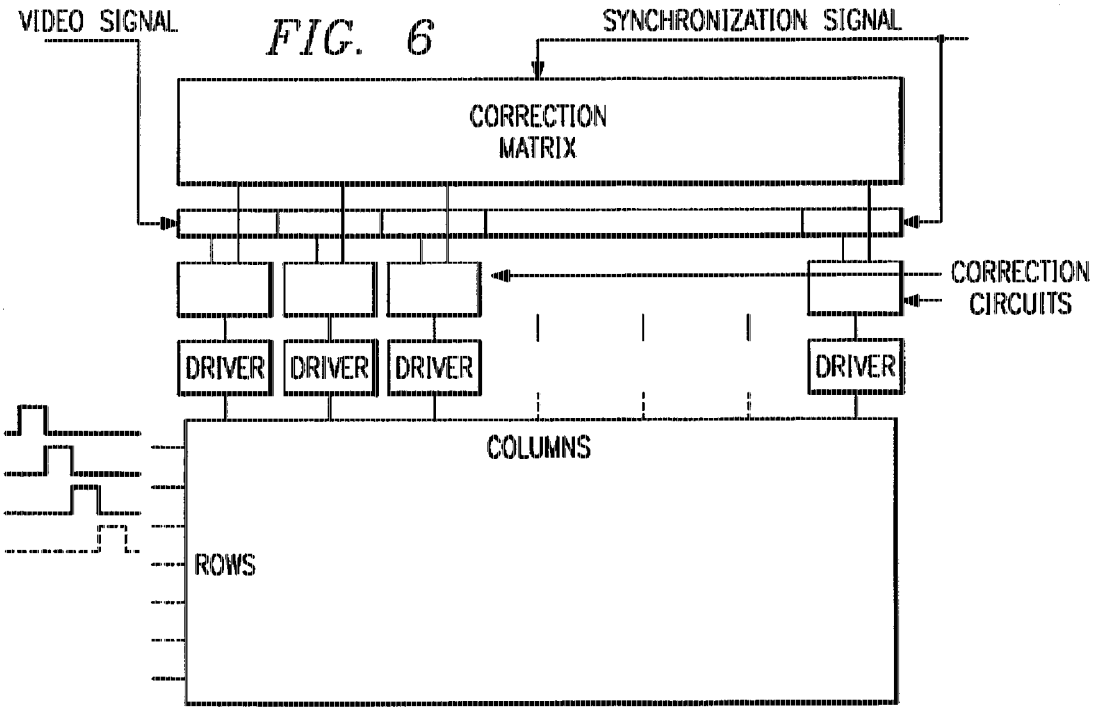
FIG. 6 shows an alternative architecture of the correction system of the invention, particularly suited for video systems.

According to an important aspect of the present invention, in this type of (video) application, the correction values can be read sequentially from the correction memory by using, for example, the row and screen synchronization signals present in the incoming video signal for activating an address generator and introducing a correction in the serial signal before its parallelization, as illustrated in FIG. 5.

According to this embodiment, the circuitry may be simplified and memories of a standard type can be used, through a rather high memory reading speed and a correction algorithm capable of being implemented at high speed are required.

According to a further alternative embodiment of this invention, a conceptually simpler solution is that of using a memory array structured in rows and columns, as for example a CCD, whose internal organization in rows and columns "duplicates" that of the pixels of the FED screen itself. In this case, the correction values can be loaded in parallel on the column drivers of the screen, as depicted in FIG. 5. The speed requirements are in this case less stringent, even if at the expenses of a greater circuitry complexity, because the correction circuitry must be duplicated for each column driver (CORRECTION CIRCUIT).

Further to what has been described above, the correction memory can be of the analog type, for instance based on a CCD or on an analog EEPROM, and correction implemented directly by an analog circuitry.

Obviously, various combinations of the above embodiments of the invention are also possible.

For instance, it may be possible to use a first nonvolatile memory for example of the EPROM type, in which a matrix of initial correction values, which may preferably compensate for disuniformities of the anodic structure (phosphors) too, is stored. This basic (or initial) correction matrix may be established by testing as described above. In a second updatable memory array, for example of the DRAM or CCD type, a "map" of the pixel currents is stored at every power-on.

The correction signal (value) for each pixel may be obtained by combining the respective correction factors stored in the two distinct memory arrays, or in a simpler and less dissipative way, by generating an updated matrix of correction values in the second memory array by writing therein the resulting value of the combination of the pixel current level read at power-on with the corresponding basic correcting parameter stored in the nonvolatile memories. In this way, pixel signal processing would be performed once at power-on and the correction system will read only one memory at each screen refresh.

According to a disclosed class of innovative embodiments, there is provided: A field emission display (FED) comprising a cathodic structure in the form of conductive strips defined on a dielectric substrate and having field stimulable electron emission sites distributed over their surface, each strip being individually biasable in sequence by a column scanning circuitry of a pixel driving matrix of the display, which driving matrix comprises conductive extractor strips orthogonal to said columns, selectable in sequence by a row selection circuitry, characterized in that said column scanning circuitry comprises a correction memory array programmable during a testing phase of the display capable of storing relative emission efficiency values of each individual pixel of the display and biunivocally addressable with the relative excited pixel during the functioning of the display; a correction circuit of a column driving signal capable of modulating the bias of the selected column as a function of a video signal and of the values stored in said correction memory for each selected pixel.

According to another disclosed class of innovative embodiments, there is provided: A field emission display (FED) comprising a cathodic structure in the form of conductive strips defined on a dielectric substrate and having field stimulable electron emission sites distributed over their surface, each strip being individually biasable in sequence by a column scanning circuitry of a pixel driving matrix of the display, which driving matrix comprises conductive extractor strips orthogonal to said columns, selectable in sequence by a row selection circuitry, characterized in that it comprises a first nonvolatile memory capable of storing values of relative emission efficiency of each pixel reflecting a compound emission efficiency of the cathodic and anodic structure of the display as measured during a testing of the device; a logic circuit capable of sequentially stimulating each row with a constant biasing signal, reading the value of the current through each column driving stage, generating a value of relative emission efficiency of the cathodic structure alone for each pixel, and combining said value with the corresponding value stored in said first nonvolatile correction memory; at least a second electrically alterable memory, capable of storing said combined value of relative efficiency of each pixel when turning-on the display; said second memory storing a matrix of correction values that are read at every screen refreshing.

According to another disclosed class of innovative embodiments, there is provided: A method for controlling the cathode current in a field emission display (FED), characterized in that comprises determining and storing a value representative of the relative emission efficiency of each individual pixel during a preoperative phase; modulating the bias of each selected pixel in function of a video signal and of a correction signal represented by said stored value during a functioning phase.

According to another disclosed class of innovative embodiments, there is provided: A field emission display (FED) system comprising: a cathodic structure having individually selectable columns comprised of conductive strips defined on a dielectric substrate and field stimulable electron emission sites distributed on a surface of said strips; conductive extractor strips forming rows orthogonal to said columns; a pixel driving matrix connected to bias individual ones of said columns and rows to stimulate selected ones of said sites; a correction memory array programmable during a testing phase of the display capable of storing relative emission efficiency values of each individual pixel of the display; a correction circuit connected to receive a video signal and the value of a memory cell which corresponds to said video signal, and connected to provide said pixel driving matrix with a column driving signal derived from said value and said video signal; wherein said testing phase is entered when said display is powered on.

According to another disclosed class of innovative embodiments, there is provided: A field emission display (FED) system comprising: a cathodic structure having individually selectable columns comprised of conductive strips defined on a dielectric substrate and field stimulable electron emission sites distributed on a surface of said strips; conductive extractor strips forming rows orthogonal to said columns; a pixel driving matrix connected to bias individual ones of said columns and rows to stimulate selected ones of said sites; a correction memory array programmable during a testing phase of the display capable of storing relative emission efficiency values of each individual pixel of the display; a correction circuit connected to receive a video signal and the value of a memory cell which corresponds to said video signal, and connected to provide said pixel driving matrix with a column driving signal derived from said value and said video signal; wherein said testing phase is entered when said display is powered on.

According to another disclosed class of innovative embodiments, there is provided: A field emission display (FED) system comprising: a cathodic structure having individually selectable columns comprised of conductive strips defined on a dielectric substrate and field stimulable electron emission sites distributed on a surface of said strips; conductive extractor strips forming rows orthogonal to said columns; a pixel driving matrix connected to bias individual ones of said columns and rows to stimulate selected ones of said sites; a correction memory array programmable during a testing phase of the display capable of storing the current ouput of each individual pixel of the display; a correction circuit connected to receive a video signal and the value of a memory cell which corresponds to said video signal, and connected to provide said pixel driving matrix with a column driving signal derived from said value and said video signal; wherein said testing phase is entered when said display is powered on.

According to another disclosed class of innovative embodiments, there is provided: A field emission display (FED) system comprising: a cathodic structure having individually selectable columns comprised of conductive strips defined on a dielectric substrate and field stimulable electron emission sites distributed on a surface of said strips; conductive extractor strips forming rows orthogonal to said columns; a pixel driving matrix connected to bias individual ones of said columns and rows to stimulate selected ones of said sites; a non-volatile first correction memory array containing values corresponding to emission efficiency values of each individual pixel of the display as determined at time of manufacture; a volatile second correction memory array programmable periodically during a test phase of the display capable of storing relative emission efficiency values of each individual pixel of the display as determined at the time of each testing; a correction circuit connected to receive a video signal and the value of a memory cell of each of said memories which corresponds to said video signal, and connected to provide said pixel driving matrix with a column driving signal derived from said value and said video signal; wherein said testing phase is entered when said display is powered on.

MODIFICATIONS AND VARIATIONS

As will be recognized by those skilled in the art, the innovative concepts described in the present application can be modified and varied over a tremendous range of applications, and accordingly the scope of patented subject matter is not limited by any of the specific exemplary teachings given.

As will be recognized by those skilled in the art, the innovative concepts described in the present application can be modified and varied over a tremendous range of applications, and accordingly the scope of patented subject matter is not limited by any of the specific exemplary teachings given, but is only defined by the issued claims.

What is claimed is:

1. Field emission display (FED) comprising a cathodic structure in the form of conductive strips defined on a dielectric substrate and having field stimulable electron emission sites distributed over their surface, each strip being individually biasable in sequence by a column scanning circuitry of a pixel driving matrix of the display, which driving matrix comprises conductive extractor strips orthogonal to said columns, selectable in sequence by a row selection circuitry, characterized in that said column scanning circuitry comprises a correction memory array programmable during a testing phase of the display capable of storing relative emission efficiency values of each individual pixel of the display and biunivocally addressable with the relative excited pixel during the functioning of the display;

a correction circuit of a column driving signal capable of modulating the bias of the selected column as a function of a video signal and of the values stored in said correction memory for each selected pixel.

2. The field emission display FED as defined in claim 1, characterized in that said correction memory is an array of nonvolatile memory cells of a type belonging to the group composed of EPROM, OTP and FLASH-EPROM.

3. The field emission display (FED) as defined in claim 1, characterized in that said correction memory is electrically alterable and selected from the group composed of EEPROM, RAM and SRAM and is capable of storing values of relative emission efficiency of each pixel of the display at power-on.

4. The field emission display (FED) as defined in claim 2, characterized in that each value of relative emission efficiency of individual pixels is stored as a four bits digital word.

5. The field emission display (FED) as defined in claim 1, characterized in that the values of relative emission efficiency and said correction memory array are of the analog type.

6. The field emission display (FED) as defined in claim 1, characterized in that said values of relative emission efficiency of individual pixels of the display represent the relative emission efficiency of the cathodic structure alone of the display.

7. The field emission display (FED) as defined in claim 1, characterized in that said values of relative emission efficiency of individual pixels of the display represent the overall relative emission efficiency of the cathodic structure and of an anodic structure of the display.

8. The field emission display (FED) according to claim 6, characterized in that it comprises a logic circuit capable of sequentially stimulating each row of the display with a constant biasing signal, of reading the value of the current through each column driving stage and generating a value of relative emission efficiency of each pixel to be stored in said correction memory at each powering-on of the display.

9. The field emission display (FED) according to claims 1, characterized in that said correction memory has said correction values organized in a matrix of rows and columns similarly to the pixels of said drive matrix display and a correction circuit for each column.

10. The field emission display (FED) as defined in claim 9, characterized in that said correction memory is a device chosen from the group composed of CCD and EEPROM arrays.

11. A field emission display (FED) comprising a cathodic structure in the form of conductive strips defined on a dielectric substrate and having field stimulable electron emission sites distributed over their surface, each strip being individually biasable in sequence by a column scanning circuitry of a pixel driving matrix of the display, which driving matrix comprises conductive extractor strips orthogonal to said columns, selectable in sequence by a row selection circuitry, characterized in that it comprises a first nonvolatile memory capable of storing values of relative emission efficiency of each pixel reflecting a compound emission efficiency of the cathodic and anodic structure of the display as measured during a testing of the device;

a logic circuit capable of sequentially stimulating each row with a constant biasing signal, reading the value of the current through each column driving stage, generating a value of relative emission efficiency of the cathodic structure alone for each pixel, and combining said value with the corresponding value stored in said first nonvolatile correction memory;

at least a second electrically alterable memory, capable of storing said combined value of relative efficiency of each pixel when turning-on the display;

said second memory storing a matrix of correction values that are read at every screen refreshing.

12. The field emission display (FED) according to claim 11, characterized in that said first correction memory is chosen from the group composed of EPROM, OTP and FLASH-EPROM and said second memory is chosen from the group composed of EEPROM, RAM and SRAM.

13. A method for controlling the cathode current in a field emission display (FED), characterized in that comprises determining and storing a value representative of the relative emission efficiency of each individual pixel during a preoperative phase;

modulating the bias of each selected pixel in function of a video signal and of a correction signal represented by said stored value during a functioning phase.

14. The method according to claim 13, characterized in that the value of the relative emission efficiency of each pixel is determined and stored during testing of the display.

15. The method according to claim 13, characterized in that said value for each individual pixel represents the relative emission efficiency exclusively of a cathode structure of the display's pixel.

16. The method according to claim 13, characterized in that said value also includes a component due to a respective anodic structure of the display's pixel.

17. The method according to claim 15, characterized in that said value at each pixel is determined and stored at each turning-on of the display.

18. The method according to claim 13, characterized in that comprises determining and storing a first value representative of a relative emission efficiency of each pixel by detecting and measuring the light emitted by a selectively excited pixel during a testing phase of the display;

determining a second value representative of the relative emission efficiency of the cathodic structure of each pixel, combining this second value with the corresponding first value stored during the testing phase of the display, and storing a third resultant value for each pixel in a correction memory, during a preoperative phase at each turning-on of the display;

modulating the bias of each selected pixel in functioning of a video signal and of a correction signal corresponding to said stored resultant value, during the operation of the display.

19. A field emission display (FED) system comprising:

a cathodic structure having individually selectable columns comprised of conductive strips defined on a dielectric substrate and field stimulable electron emission sites distributed on a surface of said strips;

conductive extractor strips forming rows orthogonal to said columns;

a pixel driving matrix connected to bias individual ones of said columns and rows to stimulate selected ones of said sites;

a correction memory array programmable during a testing phase of the display capable of storing relative emission efficiency values of each individual pixel of the display;

a correction circuit connected to receive a video signal and the value of a memory cell which corresponds to said video signal, and connected to provide said pixel driving matrix with a column driving signal derived from said value and said video signal;

wherein said testing phase is entered when said display is powered on.

20. The FED system of claim 19, wherein said correction memory array is a FLASH-EPROM memory.

21. The FED system of claim 20, wherein each value of relative emission efficiency of individual pixels is stored as a four bit digital word.

22. The FED system of claim 19, wherein said correction memory is electrically alterable and is capable of storing values of relative emission efficiency of each pixel of the display at power-on.

23. The FED system of claim 19, wherein the values of relative emission efficiency and said correction memory array are of the analog type.

24. The FED system of claim 19, wherein said values of relative emission efficiency of individual pixels of the display represent the relative emission efficiency of the cathodic structure alone of the display.

25. The FED system of claim 19, wherein said values of relative emission efficiency of individual pixels of the display represent the overall relative emission efficiency of the cathodic structure and of an anodic structure of the display.

26. A field emission display (FED) system comprising:

a cathodic structure having individually selectable columns comprised of conductive strips defined on a dielectric substrate and field stimulable electron emission sites distributed on a surface of said strips;

conductive extractor strips forming rows orthogonal to said columns;

a pixel driving matrix connected to bias individual ones of said columns and rows to stimulate selected ones of said sites;

a correction memory array programmable during a testing phase of the display capable of storing relative emission efficiency values of each individual pixel of the display;

a correction circuit connected to receive a video signal and the value of a memory cell which corresponds to said video signal, and connected to provide said pixel driving matrix with a column driving signal derived from said value and said video signal;

wherein said testing phase is entered periodically during use of said display.

27. The FED system of claim 26, wherein said correction memory array is a FLASH-EPROM memory.

28. The FED system of claim 27, wherein each value of relative emission efficiency of individual pixels is stored as a four bit digital word.

29. The FED system of claim 26, wherein said correction memory is electrically alterable and is capable of storing values of relative emission efficiency of each pixel of the display at power-on.

30. The FED system of claim 26, wherein the values of relative emission efficiency and said correction memory array are of the analog type.

31. The FED system of claim 26, wherein said values of relative emission efficiency of individual pixels of the display represent the relative emission efficiency of the cathodic structure alone of the display.

32. The FED system of claim 26, wherein said values of relative emission efficiency of individual pixels of the display represent the overall relative emission efficiency of the cathodic structure and of an anodic structure of the display.

33. A field emission display (FED) system comprising:

a cathodic structure having individually selectable columns comprised of conductive strips defined on a dielectric substrate and field stimulable electron emission sites distributed on a surface of said strips;

conductive extractor strips forming rows orthogonal to said columns;

a pixel driving matrix connected to bias individual ones of said columns and rows to stimulate selected ones of said sites;

a correction memory array programmable during a testing phase of the display capable of storing the current ouput of each individual pixel of the display;

a correction circuit connected to receive a video signal and the value of a memory cell which corresponds to said video signal, and connected to provide said pixel driving matrix with a column driving signal derived from said value and said video signal;

wherein said testing phase is entered when said display is powered on.

34. The FED system of claim 33, wherein said correction memory array is a FLASH-EPROM memory.

35. The FED system of claim 34, wherein each value of relative emission efficiency of individual pixels is stored as a four bit digital word.

36. The FED system of claim 33, wherein said correction memory is electrically alterable and is capable of storing values of relative emission efficiency of each pixel of the display at power-on.

37. The FED system of claim 33, wherein the values of relative emission efficiency and said correction memory array are of the analog type.

38. The FED system of claim 33, wherein said values of relative emission efficiency of individual pixels of the display represent the relative emission efficiency of the cathodic structure alone of the display.

39. The FED system of claim 33, wherein said values of relative emission efficiency of individual pixels of the display represent the overall relative emission efficiency of the cathodic structure and of an anodic structure of the display.

40. A field emission display (FED) system comprising:

a cathodic structure having individually selectable columns comprised of conductive strips defined on a dielectric substrate and field stimulable electron emission sites distributed on a surface of said strips;

conductive extractor strips forming rows orthogonal to said columns;

a pixel driving matrix connected to bias individual ones of said columns and rows to stimulate selected ones of said sites;

a non-volatile first correction memory array containing values corresponding to emission efficiency values of each individual pixel of the display as determined at time of manufacture;

a volatile second correction memory array programmable periodically during a test phase of the display capable of storing relative emission efficiency values of each individual pixel of the display as determined at the time of each testing;

a correction circuit connected to receive a video signal and the value of a memory cell of each of said memories which corresponds to said video signal, and connected to provide said pixel driving matrix with a column driving signal derived from said value and said video signal;

wherein said testing phase is entered when said display is powered on.

41. The FED system of claim 40, wherein said correction memory array is a FLASH-EPROM memory.

42. The FED system of claim 41, wherein each value of relative emission efficiency of individual pixels is stored as a four bit digital word.

43. The FED system of claim 40, wherein said correction memory is electrically alterable and is capable of storing values of relative emission efficiency of each pixel of the display at power-on.

44. The FED system of claim 40, wherein the values of relative emission efficiency and said correction memory array are of the analog type.

45. The FED system of claim 40, wherein said values of relative emission efficiency of individual pixels of the display represent the relative emission efficiency of the cathodic structure alone of the display.

46. The FED system of claim 40, wherein said values of relative emission efficiency of individual pixels of the display represent the overall relative emission efficiency of the cathodic structure and of an anodic structure of the display.

* * * * *